US006747507B1

(12) United States Patent
Sadate et al.

(10) Patent No.: US 6,747,507 B1
(45) Date of Patent: Jun. 8, 2004

(54) BIAS GENERATOR WITH IMPROVED STABILITY FOR SELF BIASED PHASE LOCKED LOOP

(75) Inventors: Aline C. Sadate, Dallas, TX (US); Wenliang Chen, Plano, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/308,947

(22) Filed: Dec. 3, 2002

(51) Int. Cl.[7] ..... G05F 1/10

(52) U.S. Cl. ..... 327/541; 327/540; 327/543; 323/315

(58) Field of Search ..... 327/538, 540, 327/541, 543, 313, 315

(56) References Cited

U.S. PATENT DOCUMENTS 5,856,742 A * 1/1999 Vulih et al. ..... 323/315
5,900,773 A * 5/1999 Susak ..... 327/539
6,150,872 A * 11/2000 McNeill et al. ..... 327/539
6,181,196 B1 * 1/2001 Nguyen ..... 327/539
6,380,723 B1 * 4/2002 Sauer ..... 323/315
2002/0093325 A1 * 7/2002 Ju ..... 323/316

* cited by examiner

*Primary Examiner*—Terry D. Cunningham
(74) *Attorney, Agent, or Firm*—Alan K. Stewart; W. James Brady, III; Frederick J. Telecky, Jr.

(57) ABSTRACT

A bias generator circuit with improved phase margin without RC compensation includes: a first transistor MP4; a second transistor MP3 coupled in parallel with the first transistor MP4; an amplifier A1 having a first input coupled to the first and second transistors MP4 and MP3, and to a gate of the second transistor MP3, and a second input coupled to a control voltage node VCTRL; a third transistor MN4 coupled in series with the first transistor MP4; a fourth transistor MN2 coupled in series with the third transistor MN4 and having a gate coupled to an output of the amplifier A1; a fifth transistor MP1; a sixth transistor MP2 coupled in parallel with the fifth transistor MP1; a seventh transistor MN3 coupled in series with the fifth transistor MP1; and an eighth transistor MN1 coupled in series with the seventh transistor MN3 and having a gate coupled to a gate of the fourth transistor MN2. In order to maintain the bias generator stability for different biasing conditions, the feed-forward path is removed by diode connecting the second transistor MP3 instead of connecting the gate of the second transistor MP3 to the control voltage node VCTRL.

11 Claims, 1 Drawing Sheet

BIAS GENERATOR WITH IMPROVED STABILITY FOR SELF BIASED PHASE LOCKED LOOP

FIELD OF THE INVENTION

This invention generally relates to electronic systems and in particular it relates to bias generators for self biased phase locked loops.

BACKGROUND OF THE INVENTION

A Maneatis self-biased phase locked loop (PLL) architecture is based on the prior art self-biasing techniques shown in FIG. 1. The circuit of FIG. 1 includes amplifier A1; PMOS transistors MP1, MP2, MP3, and MP4; NMOS transistors MN1, MN2, MN3, and MN4; and source voltages VDD and VSS. It is very challenging to maintain the stability of this prior art bias generator over process, temperature, and supply variation. Instability in the bias generator will result in clock jitter. Conventionally, feedback-compensation using a resistor and capacitor is used to improve the stability. However, these components sometimes occupy significant silicon area and increase cost.

The bias generator shown in FIG. 1 generates the signals at nodes VCP and VCN, which are used to bias a prior art voltage controlled oscillator (VCO) delay buffer cell shown in FIG. 2. The circuit of FIG. 2 includes PMOS transistors MP5, MP6, MP7, and MP8; NMOS transistors MN5, MN6, and MN7; input nodes VIN− and VIN+; and output nodes VO+ and VO−. The bias generator uses a half-buffer replica and a differential amplifier A1 to keep the current through the VCO delay cell constant, by forcing the voltage at node VCP equal to control voltage VCTRL. The amplifier A1 adjusts the voltage at node VCP to reject supply and substrate voltage noises.

One of the challenges involved in the design of the bias. generator is to maintain stability for applications requiring the VCO to function over a wide frequency range. A block diagram of the bias generator is shown in FIG. 3. H3(S), H2(S) and A(S) represent transfer functions associated respectively with transistors MN3 and MP2 and the amplifier A1. The circuit has two main poles and a zero:

$$P_1 = -\frac{1}{ClR_o},\ P_2 = -\frac{gm_4 + gds_3 + gds_4}{Cl_2} \text{ and } Z_1 = \frac{Gm.gm_2R_o - gm_3}{gm_3ClR_o}$$

where Gm represents the transconductance of the input transistor of amplifier A1, $gm_4$ represents the transconductance of transistor MN4, $gm_2$ represents the transconductance of transistor MN2, $gm_3$ represents the transconductance of transistor MN3, $gds_3$ represents the conductance of transistor MN3 and $gds_4$ represents the conductance of transistor MN4. $P_1$ and $P_2$ are the two main poles, and $Z_1$ is the zero. Cl and $Cl_2$ represent the load on nodes VCN and VFB respectively and $R_o$ is the output resistance of amplifier A1.

For applications operating over a wide frequency range, and thus a wide control voltage VCTRL range, the location of the poles and zero are always changing, making stability a concern. For example, there is a possibility that the zero, which is in the right half plane, will move to the left half plane for $Gmgm_2R_o << gm_3$. Furthermore, for $gm_3$=Gm, and assuming $gm4 >> (gds_4+gds_3)$, the poles and zero locations become:

$$P_1 = -\frac{1}{ClR_o},\ P_2 = -\frac{gm_4}{Cl_2} \text{ and } Z_1 = \frac{gm_2}{Cl}$$

The new poles and zero locations indicate the presence of a doublet that may deteriorate the time response.

One of the prior art solutions is RC compensation, but this does not eliminate the pole-zero doublet. Also, RC compensation may work well for a given control voltage but with different control voltage VCTRL, the transconductance of transistor MN2 varies making RC compensation difficult to realize for a wide range of control voltages.

SUMMARY OF THE INVENTION

A bias generator circuit with improved phase margin without RC compensation includes: a first transistor; a second transistor coupled in parallel with the first transistor; an amplifier having a first input coupled to the first transistor and to a gate of the second transistor, and a second input coupled to a control voltage node; a third transistor coupled in series with the first transistor; a fourth transistor coupled in series with the third transistor and having a gate coupled to an output of the amplifier; a fifth transistor; a sixth transistor coupled in parallel with the fifth transistor; a seventh transistor coupled in series with the fifth transistor; and an eighth transistor coupled in series with the seventh transistor and having a gate coupled to a gate of the fourth transistor. In order to maintain the bias generator stability for. different biasing conditions, the feed-forward path is removed by diode connecting the second transistor instead of connecting the gate of the second transistor to the control voltage node.

DETAILED DESCRIPTION OF PREFERRED EMBODIMENTS

The solution according to the present invention stabilizes the bias generator to provide larger phase margin without using RC compensation, thus providing cost saving.

Figure 1:
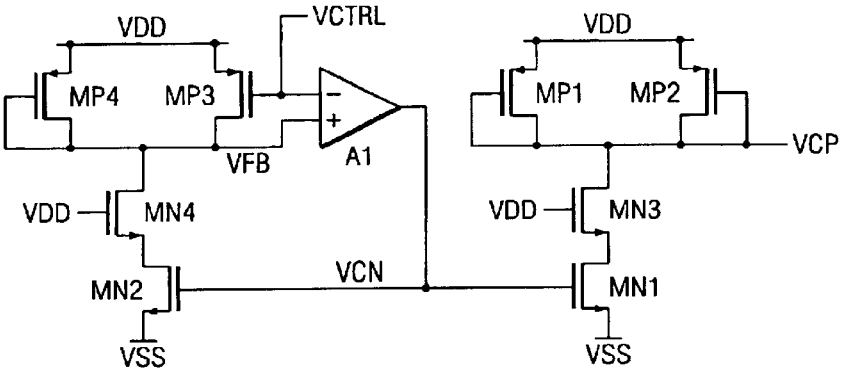
FIG. 1 is a schematic circuit diagram of a prior art bias generator for a self biased phase locked loop.
Figure 2:
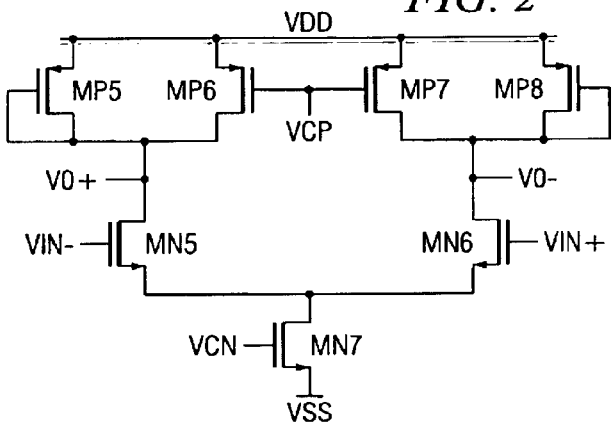
FIG. 2 is a schematic circuit diagram of a prior art voltage controlled oscillator delay buffer cell.
Figure 3:
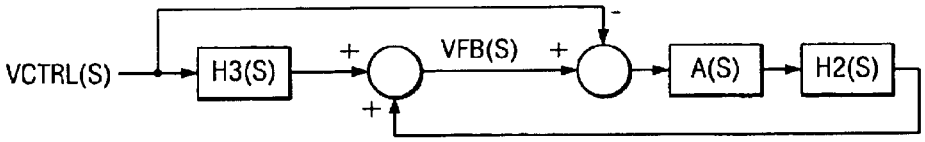
FIG. 3 is a block diagram of the bias generator shown in FIG. 1.
Figure 4:
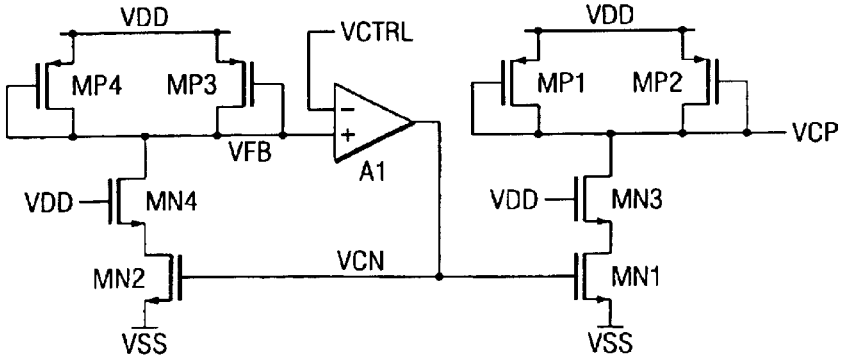
FIG. 4 is a schematic circuit diagram of a preferred embodiment bias generator with improved stability for a self biased phase locked loop.

A preferred embodiment bias generator is shown in FIG. 4. The difference between the circuit of FIG. 4 and the prior art circuit of FIG. 1 is that the gate of transistor MP3 is coupled to node VFB in FIG. 4 instead of to the control voltage VCTRL. In order to maintain the bias generator stability for different biasing conditions, the feed-forward path is removed by disconnecting control voltage VCTRL from the gate of transistor MP3 and diode connecting transistor MP3, as shown in FIG. 4. With these changes, the poles and zero in the circuit move to:

$$P_1 = -\frac{1}{ClR_o},\ P_2 = -\frac{2gm_4}{Cl_2} \text{ and } Z_1 = \frac{gm_2}{Cgd_2}$$

where $Cgd_2$ represents the gate-drain capacitance of transistor MN2.

The zero $Z_1$ and the second pole $P_2$ are therefore moved to higher frequencies. The change in the circuit also results in the elimination of the pole-zero doublet. Furthermore, the risk of having the zero moving to the left hand plane is also eliminated.

In the preferred embodiment bias generator shown in FIG. 4, as in the prior art shown in FIG. 1, node VFB and thus node VCP, still track control voltage VCTRL, thereby rejecting supply and substrate noises.

The preferred embodiment circuit of FIG. 4 provides an improvement in the stability of the Maneatis bias generator. The change in the circuit improves its stability without using capacitor and resistor, and maintaining the advantages for good substrate and supply rejections.

The preferred embodiment provides two advantages. First, the pole-zero doublet is eliminated, which improves the time response of the circuit. Secondly, the pole frequency at node VFB is pushed farther away from the first pole thereby improving the overall stability of the loop, that is:

$$P_2 = -\frac{gm_4}{Cl_2} \text{ becomes } P_2 = -\frac{2gm_4}{Cl_2},$$

where $Cl_2$ is the total output capacitance at the positive input of amplifier A1. The system can be reduced to one with a single dominant pole thereby ensuring stability.

The prior art architecture exhibits both high undershoot and overshoot before settling to the final value. With the preferred embodiment architecture, there is no undershoot and the overshoot is reduced. This overshoot can further be suppressed by adding an extra capacitor load. These overshoots and undershoots are very critical to PLL jitters.

While this invention has been described with reference to an illustrative embodiment, this description is not intended to be construed in a limiting sense. Various modifications and combinations of the illustrative embodiment, as well as other embodiments of the invention, will be apparent to persons skilled in the art upon reference to the description. It is therefore intended that the appended claims encompass any such modifications or embodiments.

What is claimed is:

1. A bias generator circuit comprising:

a first transistor;

a second transistor having a first end coupled to a first end of the first transistor, a second end coupled to a second end of the first transistor, and a gate coupled to a gate of the first transistor;

an amplifier having a first input coupled to the second end of the first transistor and to the gate of the second transistor, and a second input coupled to a control voltage node;

a third transistor having a first end coupled to the second end of the first transistor;

a fourth transistor having a first end coupled to a second end of the third transistor and having a gate coupled to an output of the amplifier;

a fifth transistor;

a sixth transistor having a first end coupled to a first end of the fifth transistor, a second end coupled to a second end of the fifth transistor, and a gate coupled to a gate of the fifth transistor;

a seventh transistor having a first end coupled to the second end of the fifth transistor; and an eighth transistor with a first end coupled to a second end of the seventh transistor and having a gate coupled to a gate of the fourth transistor; and wherein the first, second, fifth, and sixth transistors are PMOS transistors; and the third, fourth, seventh, and eighth transistors are NMOS transistors.

2. The circuit of claim 1 wherein the amplifier is a differential amplifier.

3. The circuit of claim 2, wherein the first input of the amplifier is a positive input terminal and the second input of the amplifier is a negative input terminal.

4. The circuit of claim 1 wherein the first end of the first transistor is coupled to a first power supply node.

5. The circuit of claim 4 wherein the first end of the fifth transistor is coupled to the first power supply node.

6. The circuit of claim 5 wherein a second end of the fourth transistor is coupled to a second power supply node.

7. The circuit of claim 6 wherein a second end of the eighth transistor is coupled to the second power supply node.

8. The circuit of claim 7 wherein a gate of the third transistor is coupled to the first power supply node.

9. The circuit of claim 8 wherein a gate of the seventh transistor is coupled to the first power supply node.

10. The circuit of claim 1 wherein the gate of the fifth transistor is coupled to the first end of the seventh transistor.

11. A bias generator circuit comprising:

a first transistor having a first end coupled to a first supply node and a second end coupled to a control node of the first transistor;

a second transistor having a first end coupled to the first supply node, a second end coupled to the second end of the first transistor, and a control node coupled to the second end of the second transistor;

an amplifier having a first input coupled to the second end of the first transistor and a second input coupled to a control voltage input;

a third transistor having a first end coupled to the second end of the first transistor;

a fourth transistor having a first end coupled to a second end of the third transistor and having a gate coupled to an output of the amplifier;

a fifth transistor having a first end coupled to the first supply node and a second end coupled to a control node of the fifth transistor;

a sixth transistor having a first end coupled to the first supply node, a second end coupled to the second end of the fifth transistor, and a control node coupled to the second end of the sixth transistor;

a seventh transistor having a first end coupled to the second end of the fifth transistor; and an eighth transistor having a first end coupled to a second end of the seventh transistor and having a gate coupled to a gate of the fourth transistor.

* * * * *